United States Patent [19]

Mayer et al.

[11] 3,994,093

[45] Nov. 30, 1976

[54] WINDOW WITH SASH CAPABLE OF PIVOTING MOVEMENT ABOUT TWO PERPENDICULAR AXES

[75] Inventors: Siegfried Mayer, Wolbeck; Paul Greisner, Telgte, both of Germany

[73] Assignee: Aug. Winkhaus, Telgte, Germany

[22] Filed: May 29, 1975

[21] Appl. No.: 581,777

[30] Foreign Application Priority Data

| | | |
|---|---|---|
| May 30, 1974 | Germany | 2426030 |
| Dec. 23, 1974 | Germany | 2461268 |
| Apr. 15, 1975 | Germany | 2516411 |

[52] U.S. Cl. ..... 49/192

[51] Int. Cl.[2] ..... E05D 15/52

[58] Field of Search ..... 49/192, 193

[56] References Cited

UNITED STATES PATENTS

| | | | |
|---|---|---|---|
| 3,368,306 | 2/1968 | Von Wedel et al. | 49/192 |
| 3,866,355 | 2/1975 | Jacob | 49/192 |

FOREIGN PATENTS OR APPLICATIONS

| | | | |
|---|---|---|---|
| 243,127 | 10/1965 | Austria | 49/192 |

*Primary Examiner*—Kenneth Downey
*Attorney, Agent, or Firm*—Hans Berman

[57] ABSTRACT

In a window whose sash may be swung in the window frame about hinges having a vertical axis or tilted in bearings about a horizontal axis, the sash and frame have dovetail grooves in which the hinge and bearing elements and other fittings can be installed by means of conforming mounting portions without tools or with simple hand tools.

15 Claims, 26 Drawing Figures

WINDOW WITH SASH CAPABLE OF PIVOTING MOVEMENT ABOUT TWO PERPENDICULAR AXES

This invention relates to windows, and particularly to an improved window of the type in which the sash may be swung in the window frame about hinges having a vertical axis or tilted in bearings about a horizontal axis near the window sill.

It is the primary object of the invention to provide a window of the type described whose hinge, bearing, and other fittings may be installed at a construction site without tools or with simple hand tools by unskilled labor.

It is a concomitant advantage to provide such a window which may be adapted for hinged clockwise or counterclockwise opening movement by means of the same fittings so that only one set of fittings need be stocked.

With these objects and others in view, as will hereinafter become apparent, the window of the invention has a frame including first, second, third, and fourth elongated frame members extending about an opening in the frame. The sash has analogous four members and is connected to the frame by a hinge arrangement for swinging movement about a first axis extending in a common direction with the first and third frame members toward and away from a closed position in which each sash member is contiguously juxtaposed in the frame opening to a corresponding frame member.

Additionally, the sash is connected to the frame by a bearing arrangement for tilting movememt about a second pivot axis, transverse to the first pivot axis and extending in a common direction with the second and fourth frame members toward and away from the closed position. A first corner of the frame and sash is defined by the respective first and second members, and second, third, and fourth corners are defined by the second and third, third and fourth, and fourth and first members respectively.

The hinge arrangement includes a corner fitting assembly having respective, movably engaged fitting elements on the frame and on the sash adjacent the first corners which also constitute elements of the bearing arrangement, a bracket having a portion pivotally secured to the frame adjacent the fourth corner, a guiding device which secures another portion of the bracket to the fourth sash member for angular movement and for movement longitudinally of the fourth sash member, and an arresting device on the sash for preventing such angular movement. The bearing arrangement additionally includes pivotally engageable bearing elements on the frame and on the sash respectively adjacent the second corners, and a releasable coupling device on the sash for holding the bearing elements engaged.

One or more catches on the frame and a corresponding number of locking members movable on the sash may be engaged for locking the sash to the frame in the closed position. A manually operable control member movably mounted on the sash is connected to the arresting device, the coupling device and the locking member or members by a motion transmitting mechanism. The sash is formed with an elongated, circumferential, dove-tail groove in which bar elements of the motion transmitting mechanism are received for movement longitudinally of respective sash members. A corner coupling in one sash corner connects respective bar elements associated with the sash member which define the corner. One of the connected bar elements is engaged by the control member.

The fitting element and the guiding device of the hinge arrangement on the sash and the bearing element on the sash have respective mounting portions which are conformingly received in the groove of the sash. At least one of the mounting portions bounds a passage extending therethrough longitudinally of the groove and movably receiving a longitudinal section of one of the bar elements.

Other features, additional objects, and many of the attendant advantages of this invention will readily become apparent as the same becomes better understood by reference to the following description of preferred embodiments when considered in connection with the appended drawing in which.

Figure 7:
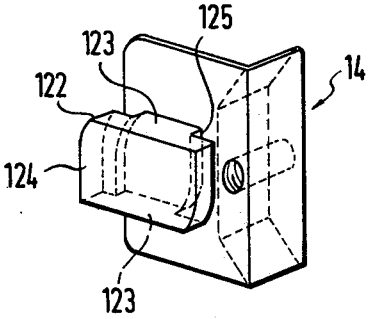
FIG. 7 is a perspective view of a catch indicated by a chain-dotted circle VII in the window of FIG. 1.
Figure 8:
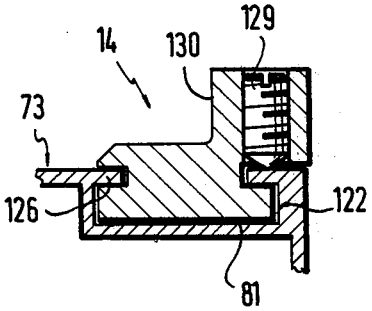
FIG. 8 shows the catch of FIG. 7 in plan section.
Figure 6:
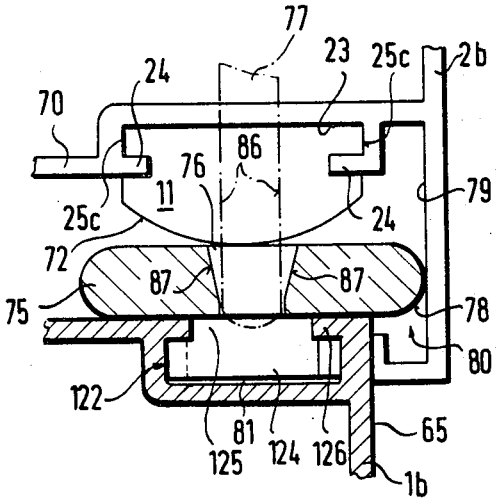
FIG. 6 shows the device of FIG. 5 in partial section on the line VI — VI.
Figure 23:
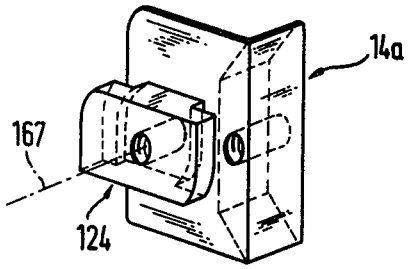
Figure 24:
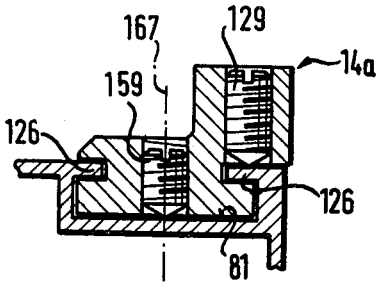
Figure 25:
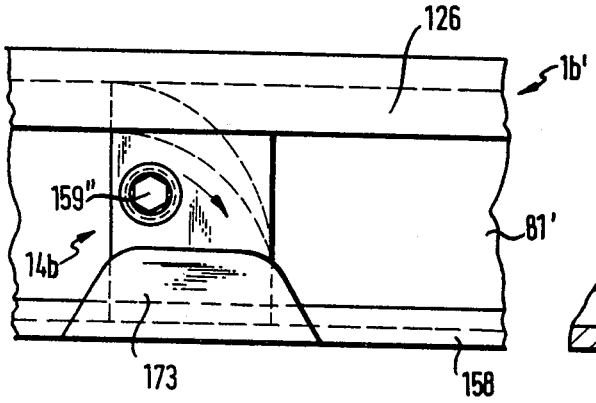
Figure 26:
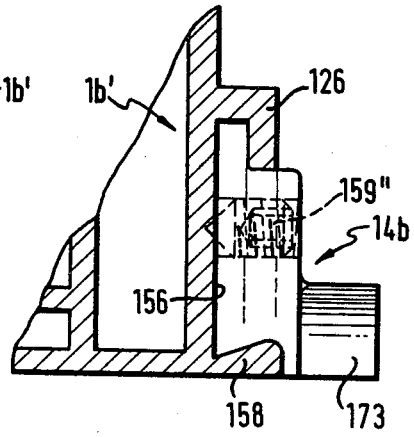

FIGS. 17, 18, 20, and 21 illustrate respective modified bearing arrangements in views corresponding to that of FIG. 6;

FIGS. 19, 22, 24, and 26 illustrate respective modified catches in views analogous to that of FIG. 8;

FIG. 23 shows the catch of FIG. 24 in a view corresponding to that of FIG. 7; and FIG. 25 shows the catch of FIG. 26 and associated frame structure as viewed from the frame opening.

Figure 1:
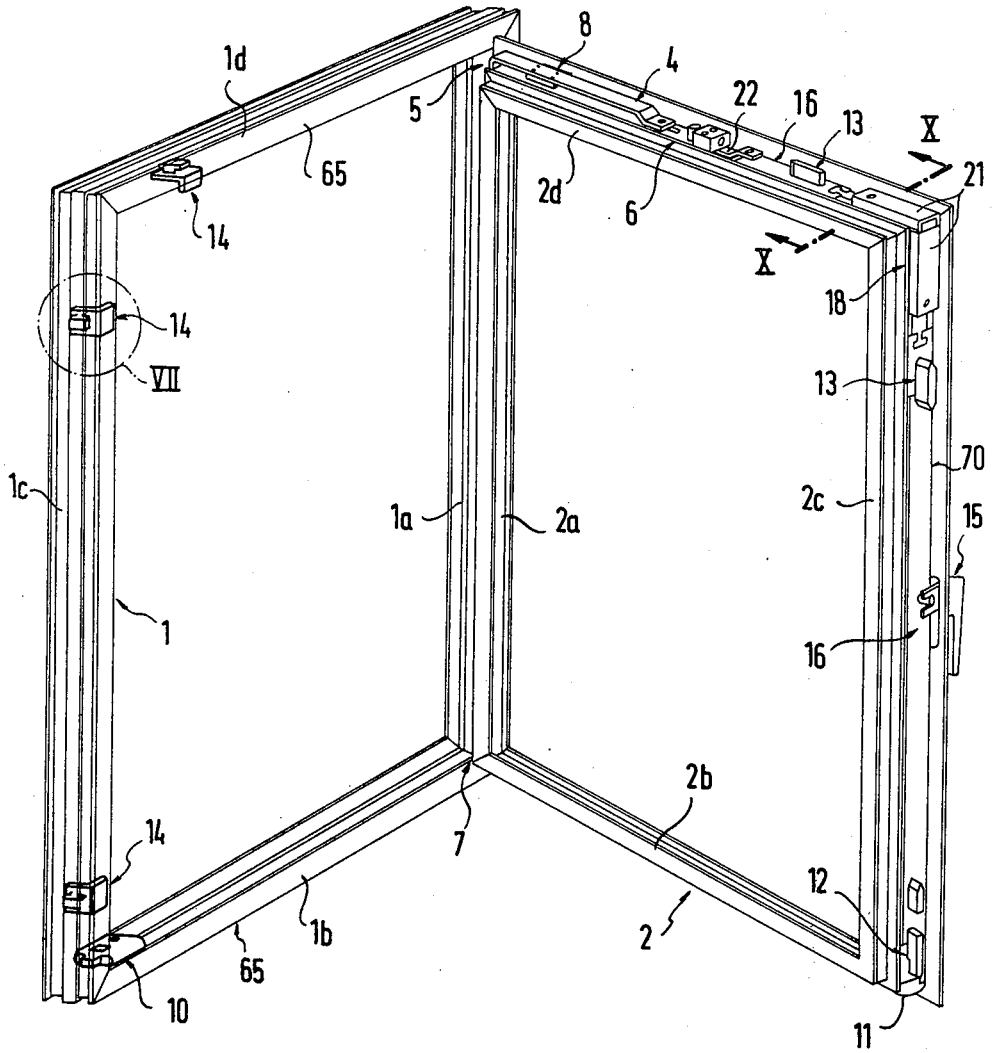
FIG. 1 shows a casement window of the invention in a perspective view.

Referring now to the drawing in detail, and initially to FIG. 1, there are seen the frame 1 and sash 2 of a window according to the invention which may be opened by swinging the sash 2 about a vertical pivot axis along the jamb or first frame member 1*a* or by tilting the sash about a horizontal pivot axis along the sill or second member 1*b* of the frame 1. The window is shown operating in the swinging mode and as seen from within a room. The window may be closed by pivoting the sash on hinges in the right top corner 5, hereinafter also referred to as the fourth corner, and the right bottom corner or first corner 7, whereby a circumferential flange on the sash 2 abuttingly engages a front face 65 of the frame 1. It may be locked in the closed position by swinging a control handle 15 on the sash 2. The handle operates locking devices 13 on the narrow circumferential edge 70 of the sash 2 which engage catches 14 on the window frame 1, the locking devices being connected to the handle 15 by a system of motion transmitting bars 16 extending along the left stile or third sash member 2*c* and the upper rail or fourth member 2*d* of the sash 2.

A fork on the handle 15 engages a pin on the bar 16 extending along the stile 2*c*. Movement is further transmitted to the bar system 16 along the rail 2*d* by a corner coupling 18 whose working elements are largely concealed in FIG. 1 by outer shell elements 21. Sections of the bar system 16 along the rail 2*d* are linked by a slim connector 22 so as not to interfere with movement of a bracket 4 which, in the position of the window illustrated in FIG. 1, is held parallel to the rail 2*d* by an arresting device 8.

In the closed position of the sash 2, bearing elements 10, 11 on the left bottom corners or second corners of the frame 1 and the sash 2 are closely juxtaposed. They may be coupled by further swinging the handle 15 to operate a coupling device 12 by means of the system of bars 16 which simultaneously release the bracket 4 from the arresting device 8. The sash 2 may then be tilted away from the fourth or lintel member 1d of the window frame 1.

The devices permitting the two modes of window operation briefly described above are shown in greater detail in FIGS. 2 to 10.

Figure 2:
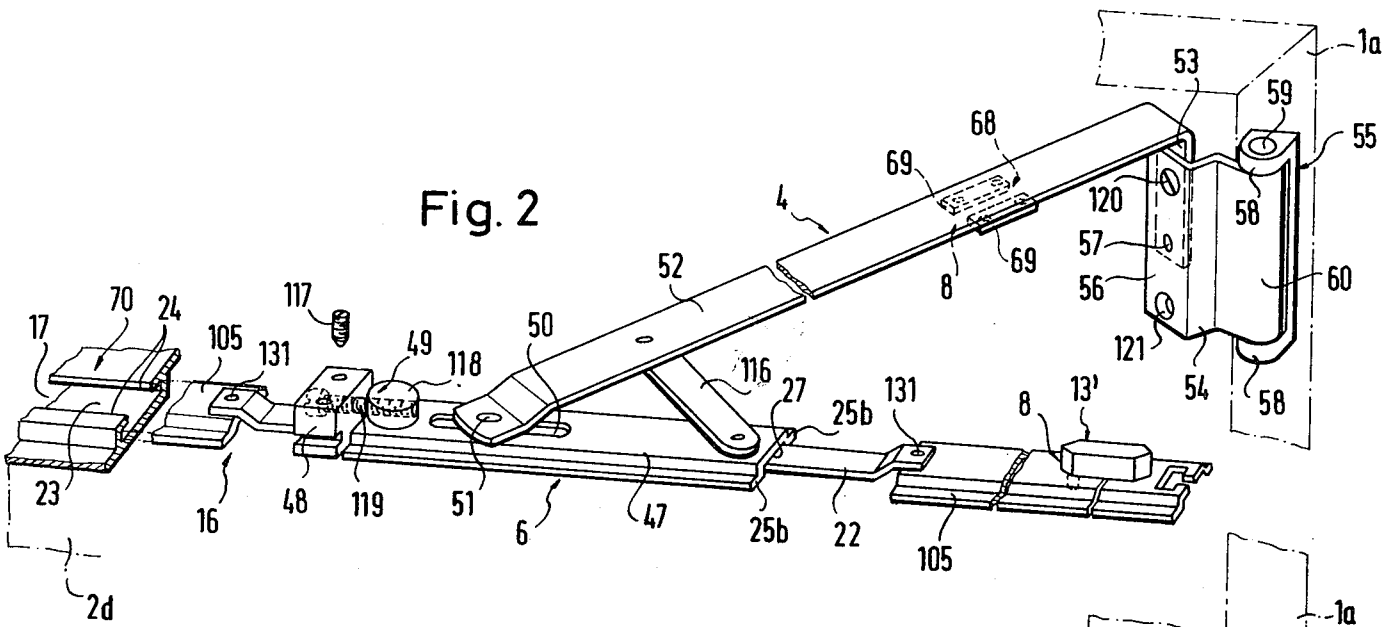
FIG. 2 is a perspective view of a hinge assembly connecting the frame in the window of FIG. 1 with the top of the sash.

FIG. 2 illustrates elements of the window in the tilted, partly open position of the sash 2. The bracket 4 is a flat metal bar bent into an L-shape. Its shorter, vertical leg 53 is permanently attached to the jamb 1a of the window frame 1 by a hinge assembly obscured in FIG. 1 in the right top corner 5 of the window. The bracket leg 53 is attached to a flat upright face 56 of a steel strap 54 by a locating pin 57 on the strap and by a screw 120 in one of two apertures 121 of the leg 53 which are symmetrically offset in opposite vertical directions from the pin 57. The strap 54 is integral with a hinge barrel 60 receiving a hinge pin 59.

Figure 4:
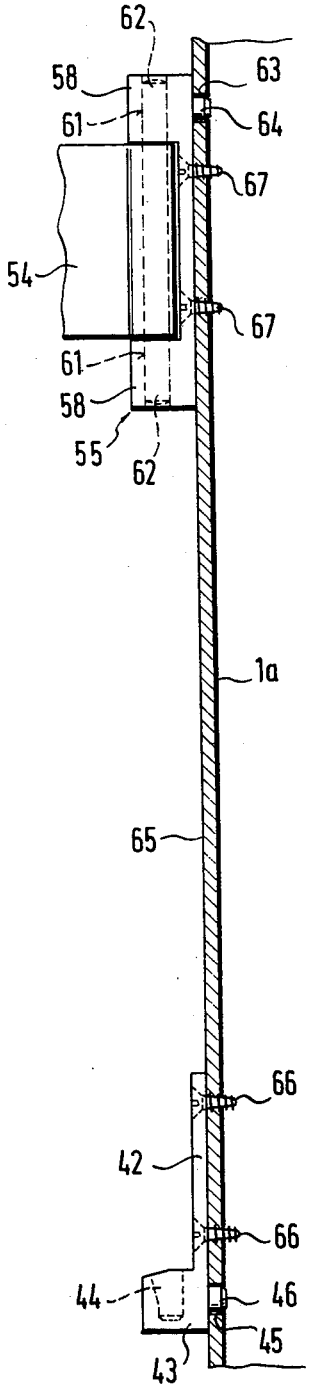
FIG. 4 shows the hinge assemblies of FIGS. 2 and 3 and a portion of the window frame in fragmentary front-elevational section.

As is better seen in FIG. 4, the two axial ends 62 of the pin 59 are rotatably received in bores 61 of respective hinge barrels 58 of a unitary mounting bracket 55 whose vertical position is precisely defined by a locating pin 64 received in a bore 63 of the jamb 1a, and which is further fastened to the jamb by self-tapping screws 67. The four sides 1*a*, 1*b*, 1*c*, 1*d* of the window frame 1 are sections of the same extruded aluminum stock.

The sides 2*a*, 2*b*, 2*c*, 2*d* of the sash 2 also consist of uniform sections of extruded aluminum stock whose configuration is partly seen in FIG. 2. The narrow circumferential edge 70 on all four members of the sash 2 is formed with a dove-tail groove 17 bounded by turned-in edges 24 so as to be approximately T-shaped in cross section. Two sliding bars 105 are conformingly guided in respective portions of the groove 17 in the upper sash rail 2*d*. They are elements of the motion transmitting system 16 and are connected with each other by the connector 22 or smaller cross section to which they are fastened by rivets 131. The connector 22 is largely concealed in FIG. 2 by a guide arrangement 6 for the bracket 4 mainly consisting of an inverted, shallow channel 47 and a fastening block 48 for the channel. The connector 22 moves freely in the cavity 27 of the channel 47 which is open toward the bottom 23 of the groove 17. Lateral flanges 25*b* constitute the mounting portion of the channel 47 and are guided in the groove 17 by the edges 24. The edges 24 engage lateral grooves in a mounting portion of the block 48 which is formed with a passage for the connector 22, not specifically shown, but similar to the cavity 27. The block 48 is clamped to the edges 24 of the groove 17 by two set screws 117 and is held adjacent an end face of the channel 47 by an adjustable spacing device 49 consisting of a screw 119 passing through a smooth bore of the block 48 between the set screws 117 and threadedly engaging a boss 118 on the channel 47.

The free end of the horizontal, longer leg 52 of the bracket 4 carries a cylindrical pin 51 which is rotatably guided in a longitudinal slot 50 of the channel 47. A link 116 hingedly connects respective portions of the bracket leg 52 and of the channel 47 spaced from the pin 51. The somewhat flexible bracket 4 thus permits the upper sash rail 2d to tilt away from the lintel member 1*d* of the frame 1 until the pin 51, moving toward the right from the position shown in FIG. 2, reaches the end of the slot 50. In the closed position of the window, the pin 51 is located in the opposite end of the slot 50, and the leg 52 is superposed on the upper sash rail 2*d* as shown in FIG. 1. It may be locked in this position when a wedge-shaped locking member 13' on one of the sliding bars 105 is shifted into a groove 68 between two longitudinal bars 69 on the underside of the bracket leg 52 by the handle 15.

Figure 3:
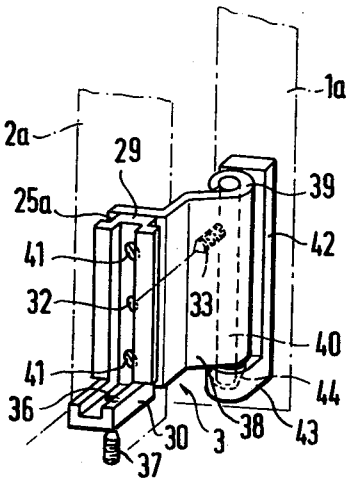
FIG. 3 is a corresponding view of a lower hinge assembly having a common pivot axis with the assembly of FIG. 2.

The hinge 3 in the lower right window corner 7 which permits both swinging and tilting movement of the sash 2 is shown in FIG. 3 and partly also in FIG. 4. A bracket 42 is precisely positioned on the jamb 1a in vertical alignment with the bracket 55 by a locating pin 46 engaging an opening 45 in the jamb and by two screws 66. It integrally carries a receptacle 43 formed with a blind bore 44 which conically flares in an upward direction. The bore 44 tiltably and rotatably receives the lower end of a hinge pin 40 secured in a barrel 39 which is an integral part of a strap 38.

Two screws 41 attach an upright mounting channel 29 to the strap 38 and are arranged symmetrically relative to a threaded bore 32 in the channel. Longitudinal flanges 25*a* of the channel 29 may be inserted under the inturned edges 24 of the groove 17 in the first sash member or sash stile 2*a*. A horizontally elongated U-channel 30 is integral with the channel 29 and fits between the edges 24 in the second sash member or lower sash rail 2*b*. The sash 2 may thus be mounted on the hinge assembly 3 by sliding the groove 17 of the stile 2a over the channel 29 until the channel 30 hits the bottom 23 of the groove 17 in the lower rail 2*b*. The relative position of the sash 2 and the hinge assembly 3 may be set by means of set screws 33, 37 normally received in the threaded bore 32 of the channel 29 and a corresponding threaded bore 36 in the web of the channel 30. The angular position of the sash 2 relative to the window frame 1 may be further adjusted by turning the screw 119 in the boss 118 of the channel 47 (FIG. 2).

Figure 5:
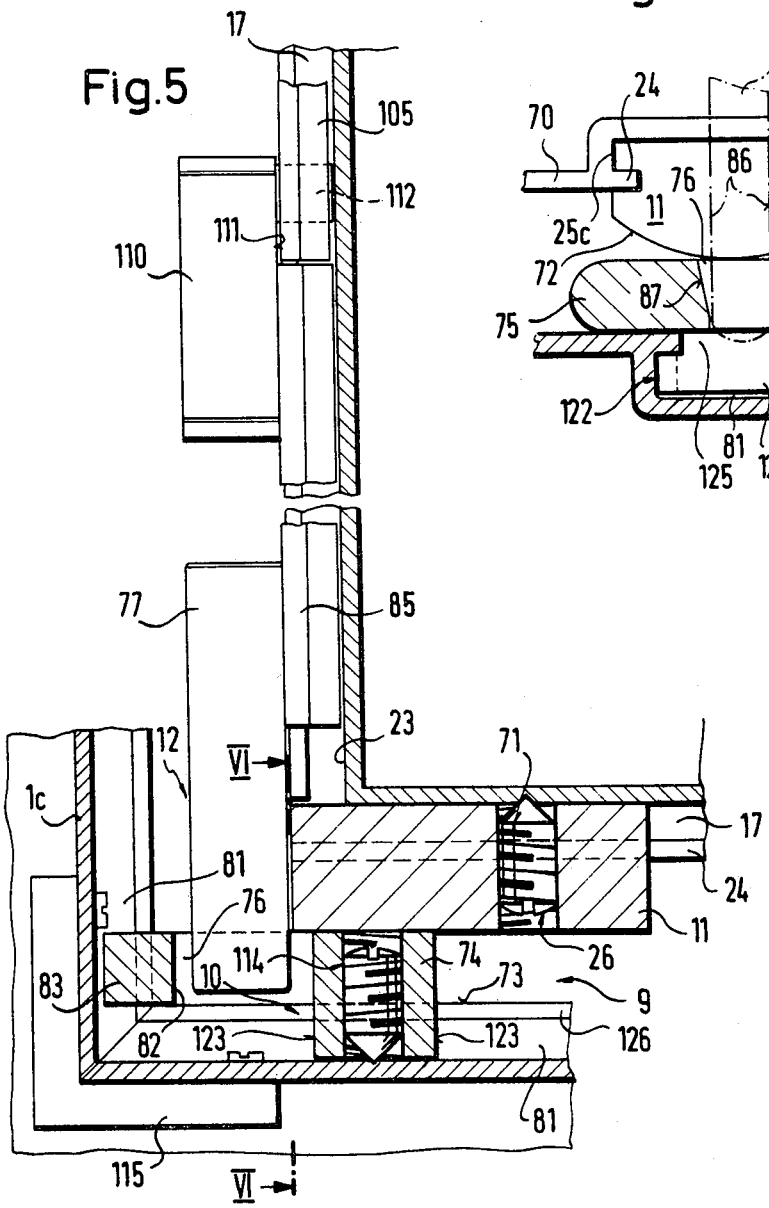
FIG. 5 illustrates a bottom corner of the closed window remote from the hinge assembly of FIG. 3 in front elevational section.

The bearing arrangement in the left lower window corner 9 for tilting the sash 2 is shown in FIGS. 5 and 6 in its operating condition. The bearing element 11 has lateral mounting flanges 25*c* slidably retained in the groove 17 of the lower rail 2*b* by the edges 24 and is secured in the illustrated position by a clamping screw 71 in a bore 26 of the element 11 which engages the bottom 23 of the groove 17. The bottom or contact face 72 of the element 11 is approximately cylindrically convex about an axis parallel to the sash members 2*b*, 2*d* and rests on a plate portion 75 of the bearing element 10. A mounting portion 74 of the element 10 is slidably received in a longitudinal dove-tail groove 81 of the sill member 1*b* and has flanges 122 retained by the inturned edges 126 of the groove 81 which are received in grooves 125 of the element 10. A set screw 114 in the mounting portion 74 engages the bottom of the groove 81 for securing the bearing element 10 in the illustrated position.

The configuration of the enlarged head 124 of the mounting portion 74 is identical with that of a corresponding mounting head on each of the catches 14 of which one is shown in FIGS. 7 and 8. The unitary catch 14 has a cam portion 130 for wedging engagement with a cooperating locking member on the sash 2. Its enlarged mounting head 124 fits into the groove 81 of the frame member on which it is to be mounted so that the cam portion 130 projects beyond the outer face 73 of the frame member.

The spacing of two planar faces 123 of the head 124 is such that they fit between the edges 126 bounding the groove 81. Two diagonally opposite corners of the flanges 122 on the head 124 are cylindrically rounded, and the corresponding bottom walls of the grooves 125 are similarly rounded. Each catch 14 may thus be inserted in the groove 81 of a frame member at right angles to its ultimate position, and then turned 90° to engage the flanges 122 under the edges 126 as is shown in FIG. 8. The catch may then be secured by means of a set screw 129 in a threaded bore of the cam portion 130 which engages an edge 126.

The head of the bearing member 10 is mounted on the sill member 1*b* of the frame 1 in an analogous manner without tools and moved along the frame member into the position shown in FIG. 5 in which a projection 83 of the plate portion 75 extends into the groove 81 of the jamb or third frame member 1*c* between the edges 126, thereby further preventing movement of the bearing element 10 at right angles to the plane of FIG. 5. One of the narrow, rounded edges 78 of the plate portion 75 abuts against a fact 79 of the lower rail 2*b* in a recess 80. The frame members in each corner of the frame are connected by a corner reinforcing angle 115.

An opening 76 in the contact face of the plate portion 75 has two parallel walls 82 and two upwardly diverging walls 87 parallel to the axis of sash tilting movement. The coupling device 12 includes a flat coupling bar 77 fixedly mounted on a slide 85. The mounting slide is movably guided in the dove-tail groove 17 of the stile 2c and shifted inward and outward of the opening 76 by means of the handle 15 and the bar assembly 16 of which one bar member 105 is shown in FIG. 5. The end of the slide 85 remote from the coupling bar 77 carries the wedge member 110 of a locking device which cooperates with a catch 14 on the window frame 1 in the closed window position. A longitudinal face 111 of the locking wedge 110 carries a pin 112 received in a bore of the bar member 105. In its illustrated position, the coupling bar 77 prevents swinging movement of the sash 2 about the common axis of the hinge pins 40, 59, but permits tilting of the sash between positions of abutting engagement of parallel faces 86 of the bar 77 with the diverging walls 87 of the plate portion 75. When the sash 2 is to be swung in a horizontal plane, the bar 77 is withdrawn from the opening 76 by the control handle 15.

Figure 9:
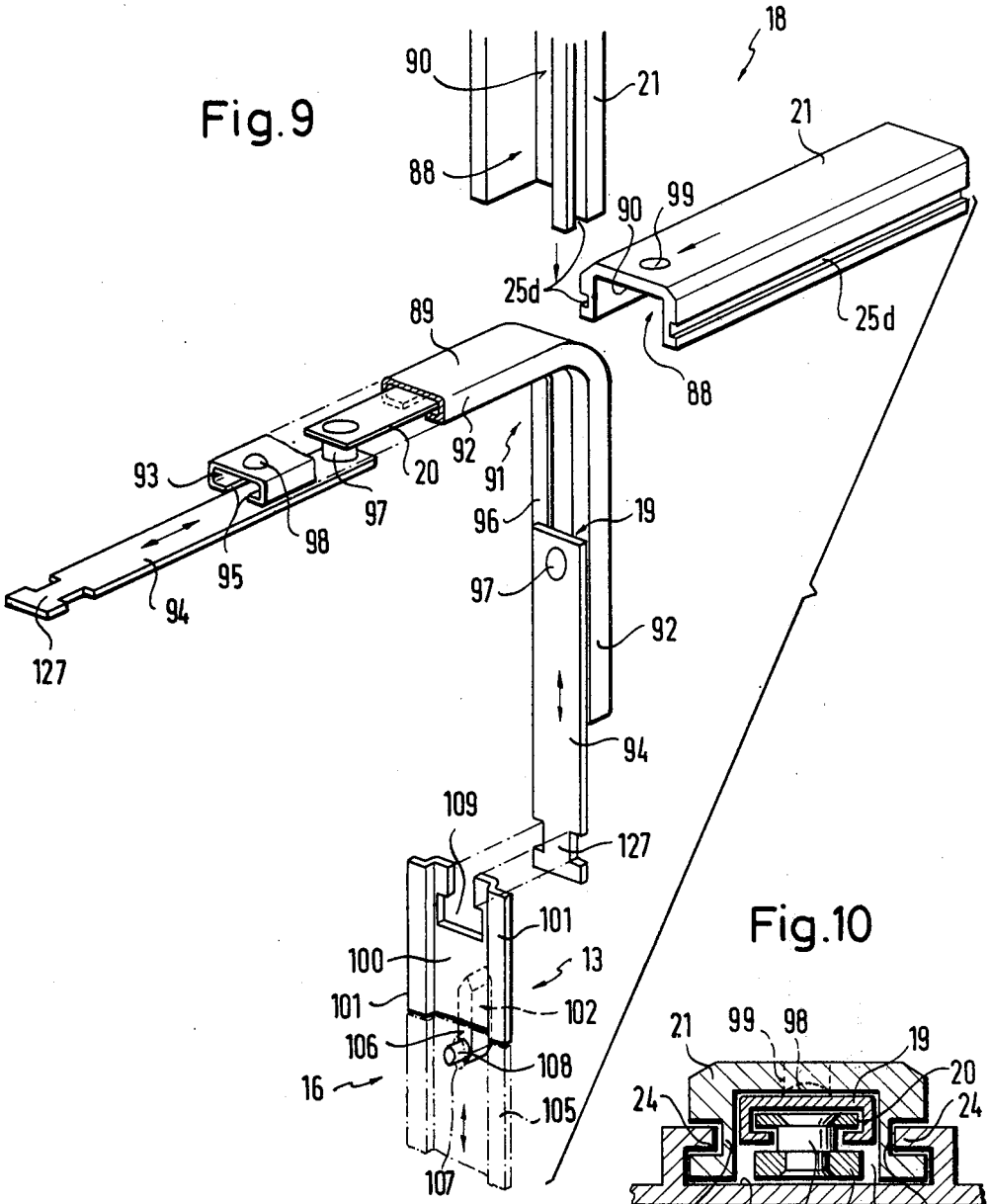
FIG. 9 is an exploded, perspective view of a corner coupling in the operating mechanism of the window of FIG. 1.
Figure 10:
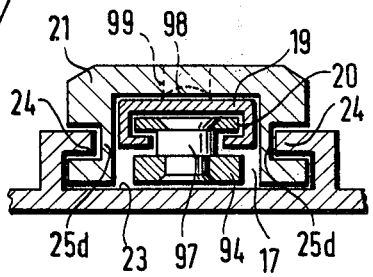
FIG. 10 shows the device of FIG. 9 in section on the line X — X in FIG. 1.

The corner coupling 18 is shown in more detail in FIGS. 9 and 10. It includes a flexible strap 20 of spring steel which is guided in an L-shaped, rigid sheath 19. The face 96 of the sheath 19 which is directed toward the bight 91 is slotted over the entire length of the sheath. Respective portions of the slot 95 in the two leg portions 89, 92 of the sheath 19 receive shoulder rivets 97 which connect the ends of the strap 20 in the cavity 93 of the sheath 19 with longitudinal ends of connectors 94 of flat bar stock. T-shaped tongues 127 on the far ends of the connectors 94 are engaged with other elements of the motion transmitting bar assemblies 16 in a manner shown in FIG. 9 by way of example.

One of the locking devices 13 has a base plate 100 whose offset mounting flanges 101 are retained by the edges 24 of the groove 17 in the stile 2*c*. A recess 109 in the base plate 100 is conformingly engaged by a tongue 127 of a connector 94. The plate 100 carries a locking wedge 102 similar to the afore-described wedge 110. A portion 106 of the wedge 102 projects beyond the plate 100 and is provided with a transverse pin 108 for engagement with a bore 107 in a sliding bar 105 of the motion transmitting bar assembly 16 driven by the handle 15.

The sheath 19 is fastened on the sash 2 by the outer shell elements 21 which are somewhat resilient brass channels of flat U-shape. The cavity 88 in each element 21 is dimensioned slidably to receive one leg of the sheath 19 as well as the associated connector 94, as is best seen in FIG. 10. Grooves 25d in the flanges of each shell element 21 are dimensioned to receive edges 24 when the element is slightly compressed in a lateral direction. In the relaxed condition, the expanded shell may be frictionally secured in the groove 17 of a sash member by its own resiliency.

The shell elements 21 may be installed on the otherwise assembled sash 2 by sliding them over the legs of the sheath 19 as indicated by arrows in FIG. 9 until dimples 98 at the two ends of the sheath 19 remote from the bight 91 drop into bores 99 in the webs 90 of respective elements 21.

The window described with reference to FIGS. 1 to 9 opens either on the left, as shown in FIG. 1, or at the top, as shown in FIG. 2, but its fittings may be used unchanged for a window opening at the top or at the right side. In such a window, the bracket 55 together with the strap 54 is turned upside down about the locating pin 57, and the screw 120 is shifted from the position seen in FIG. 2 to the threaded aperture 121 which is idle in the illustrated device. Similarly, the strap of the lower hinge assembly shown in FIG. 3 is turned 180° about the screw 33, and the hinge pin 40 is shifted axially in the barrel 39 again to project downward. All elements of the bearing arrangement illustrated in FIGS. 5 and 6 are symmetrical relative to a plane parallel to that of FIG. 5 and may thus be installed in the first window corner 7 without structural changes. The bracket 4 and the associated guide arrangement 6 may similarly be reversed. Only the stiles 2*a*, 2*c* need to be replaced if only one is to be provided with an opening for passage of the handle 15. If a second opening is not objectionable, the handling 15 may be installed on either stile.

Fittings and other elements of the window described above may be modified without basic change in window operation, as is shown in FIGS. 11 to 26.

Figure 11:
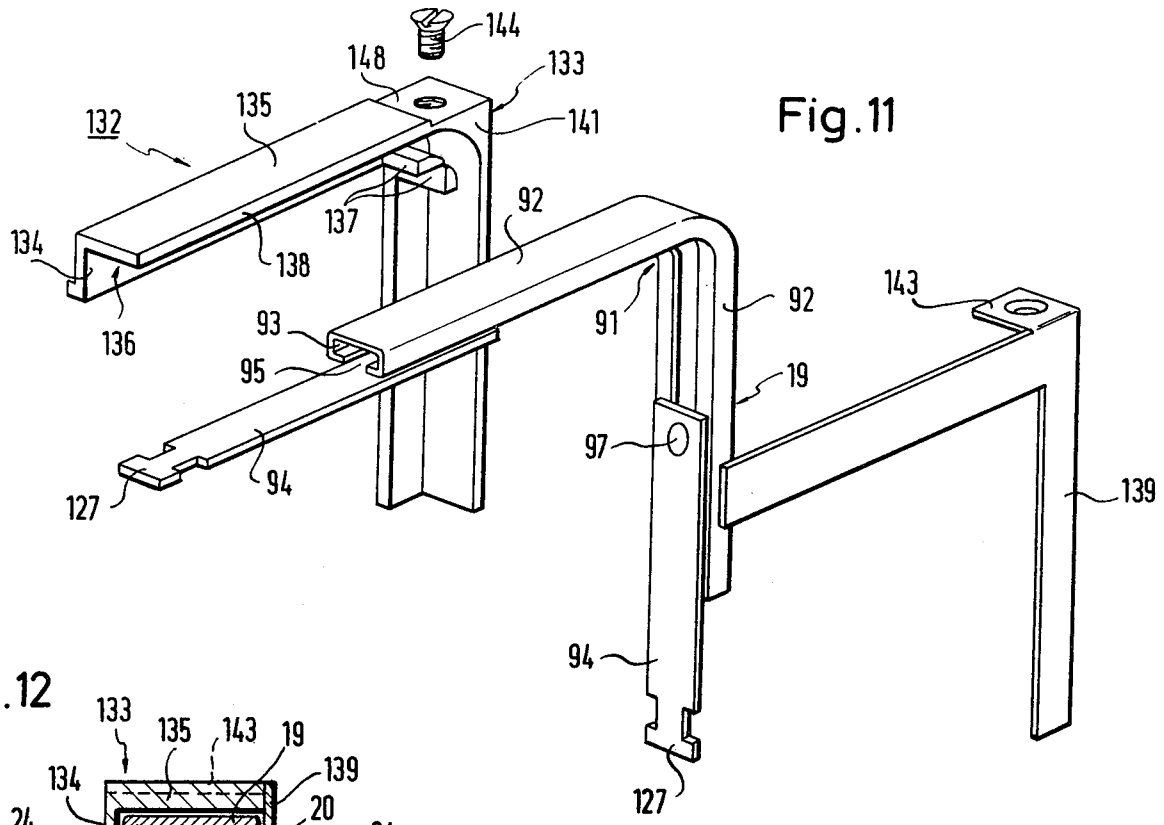
FIGS. 11 and 12 show a modified corner coupling in views respectively corresponding to those of FIGS. 9 and 10.
Figure 12:
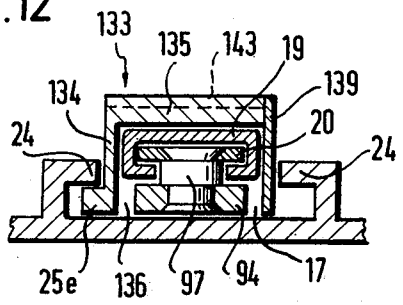

FIGS. 11 and 12 show a corner coupling connection which differs from that described with reference to FIGS. 9 and 10 by the outer shell 132 enveloping the unchanged working elements which have been provided in FIGS. 11 and 12 with the same reference numerals and will not again be described in detail.

The shell 132 has a body portion 133, preferably an aluminum or zinc diecasting, having an elongated, flat, L-shaped wall 134 and an elongated, rectangularly bent wall 135, respective longitudinal edges of the walls 134, 135 being integrally joined so as to bound two sides of a cavity 136 dimensioned to receive the sheath 19. The bight portion 91 of the sheath is secured in the cavity 136 by two bars 137 projecting from the wall 134 and spacedly parallel to the bight portion 141 of the wall 135. The third side of the cavity 136 is normally closed by a cover 139 of sheet metal extending in an L-shaped along the free longitudinal edge 138 of the wall 135, and attached to the wall 135 by an integral lug 143 received in a rabbet 148 of the bight portion 141 and secured by a screw 144. A rib **25*e* extending along the free edge of the wall 134 is received in the groove 17 of a sash member under an edge 24 when the corner coupling is assembled as is shown in FIG. 2**.

Figure 13:
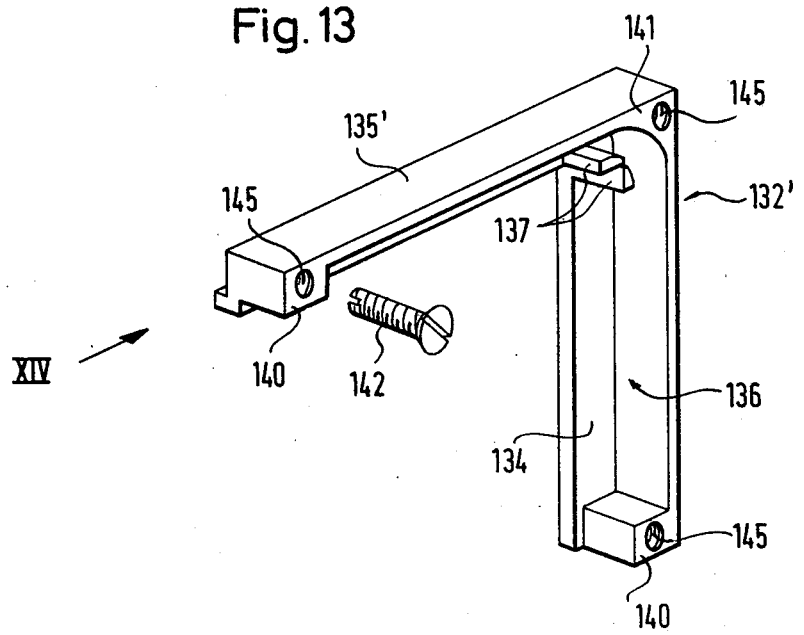
FIGS. 13 and 15 illustrate two additional corner couplings in the manner of FIG. 9.
Figure 14:
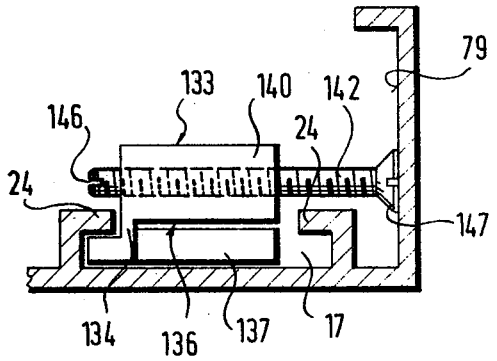
FIGS. 14 and 16 shows these couplings in the manner of FIG. 10.

In the modified shell 132' seen in FIG. 13, walls 134, 135' generally similar to or identical with the aforedescribed walls 134, 135 are additionally connected by integral blocks 140 at their ends remote from the bight portion 141 which project beyond the sheath 19. Parallel screws 142 are received in threaded bores 145 in the blocks 140 and in the bight portion 141 so that the slotted free ends 146 of their stems project outward from the wall 134. When the shell 132' is installed in the groove 17 of a sash member, as is shown in FIG. 14, the screws 142 are turned by means of a screwdriver inserted in the slotted ends until the screw heads 147 abuttingly engage the upright inner face 79 of the sash member, thereby clamping the shell under the edge 24 of the sash member, and making a cover superfluous.

Figure 15:
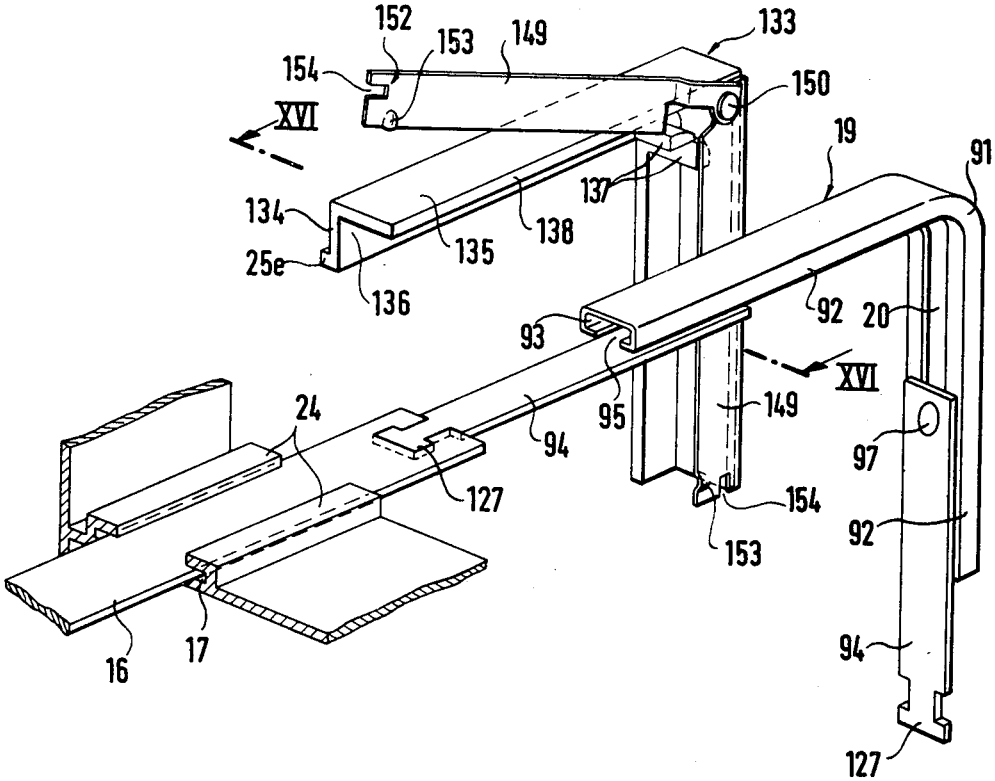
Figure 16:
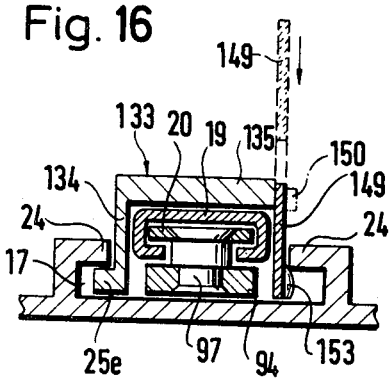

As is shown in FIGS. 15 and 16, the body portion 133 may be combined with a divided cover to fill the space between the edge 24 in the assembled window. The divided cover consists of two steel strips 149 having respective ends attached to the bight part of the body portion 133 by a common pin 150 which may be cast in. One of the strip ends is notched and slightly offset so that the strips 149 generally pivot in a common plane. After insertion of the body portion 133 and of the working elements received in the cavity 136 in the grooves 17 of two sash members connected at right angles to each other, each strip 149 is swung into the gap left between the wall 135 and an edge 24, that is, from the position shown in broken lines in FIG. 16 into the fully drawn, operative position. A dimple 153 bent out of the free end portion 152 of each strip 149 is resiliently retained under the adjacent edge 24, thereby preventing accidental movement of the strip out of the operative position. If it is desired to disassemble the corner coupling, a tool inserted in a notch 154 in the narrow transverse edge of the end portion 152 permits the dimple 153 to be dislodged.

Figure 17:
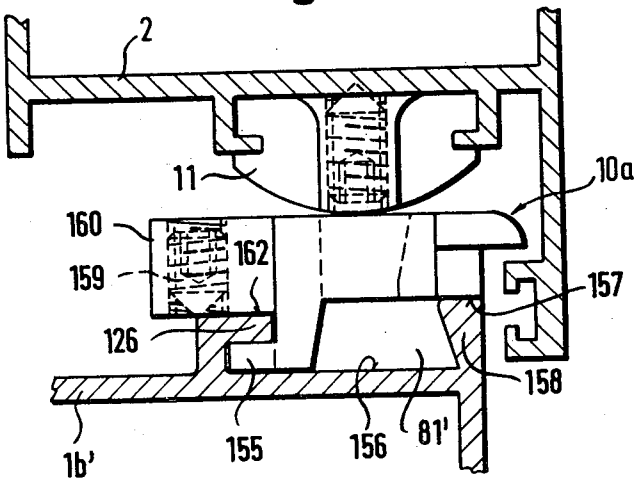

In the modified bearing arrangement shown in FIG. 17 in a view corresponding to that of FIG. 7, the convexly arcuate bearing element 11 on the sash 2 is unchanged. The bearing element **10*a* is secured on a modified frame member 1*b'* by a single flange 155 on the mounting portion of the element 10*a* which is conformingly received between the bottom 156 of the dove-tail groove 81' and an inturned edge 126 to whose top face 162 the plate portion 160 is clamped by a set screw 159. The other longitudinal side of the groove 81' is bounded by an obliquely undercut wall 158 whose top face 157 provides support for the plate portion 160 remote from the flange 155 and screw 159**.

Prior to installation of the sash 2, the bearing element **10*a* is conveniently inserted in the groove 81' and adequately secured by the screw 159 using a screw driver or wrench until the bearing element is held in the illustrated position by the bearing element 11**.

Figure 18:
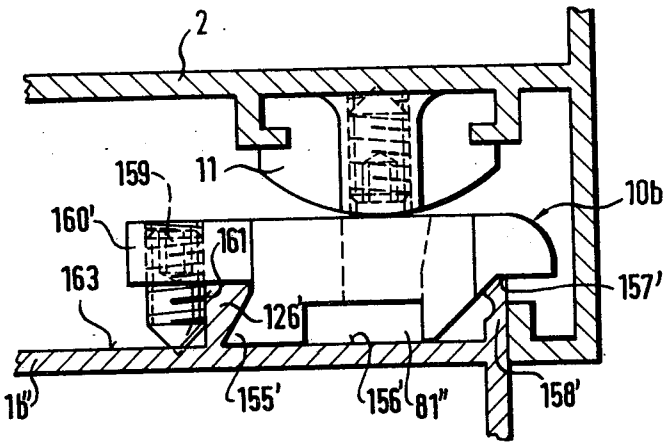

The dove-tail groove 81'' in the further modified bearing arrangement illustrated in FIG. 18 is laterally bounded by an obliquely undercut wall 126' of the frame member **1*b''* and a wall member 158' having a contact face 157' which slopes obliquely inward of the groove. The bearing element 10*b* has a tenon portion 155' conformingly engaging the wall 126' and the bottom 156' of the groove 81'. Its plate portion 160' outwardly overhangs the wall 126' and is provided with a clamping screw 159 abutting against the face 161 of the wall 126' opposite the undercut face and biting into the softer face 163 of the frame member 1*b''*. An oblique contact face of the bearing element 10*b* rests on the contact face 157', and also on the bottom 156' of the groove 81''**.

Figure 19:
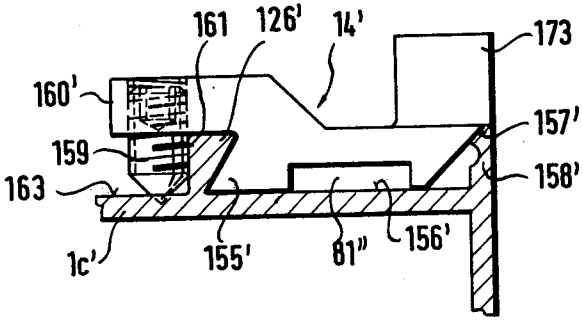

The extruded shape of the frame member **1*b''* is well suited for the mounting of a catch 14' having a mounting portion identical with that of the bearing element 10*b*, as is shown in FIG. 19. The frame member 1*c'* carrying the catch 14' is identical in cross section with the member 1*b''*, and the mounting portion of the catch 14' carries the engaging element 173** of the catch.

Figure 20:
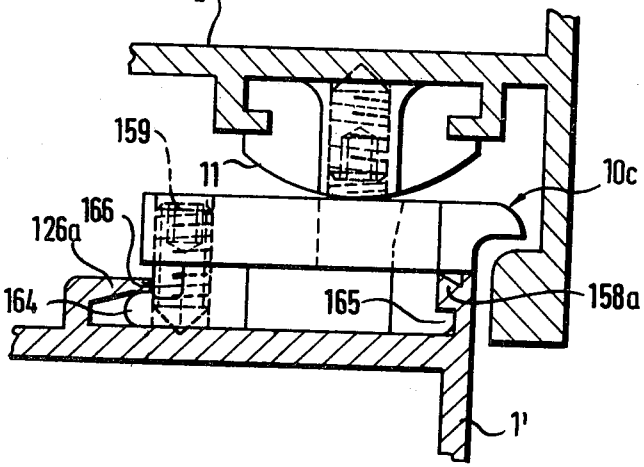

FIG. 20 illustrates a bearing arrangement having yet another bearing element **10*c* and carried by a member of a window frame 1'. A dove-tail groove in the frame 1' is partly bounded by in-turned flanges 126*a*, 158*a*, the undercut groove associated with the edge 126*a* being deeper than the groove under the edge 158*a*. The corresponding flanges 164, 165 on the mounting portion of the bearing element 10c are differently dimensioned for conforming engagement in the respective grooves, but the overall width of the mounting portion, as measured over the flanges 164, 165, is smaller than the spacing of the groove bottoms so that the wider flange 164 may be inserted deeply into the groove under the edge 126*a* until the flange 165 clears the edge 158*a*, thereby permitting the bearing element 10*c* to reach the illustrated, operative position in which it is secured by a set screw 159 extending from the plate portion downward and abutting against a lateral face 166 of the edge 126*a***.

Figure 21:
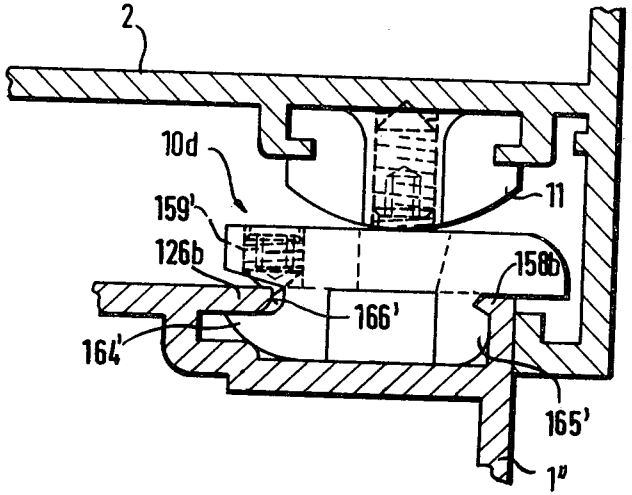

The bearing element 10d seen in FIG. 21 is mounted position on a member of a frame 1'' differs from the element 10a by a shorter set screw 159' engaging the face 166' of the edge **126*b*, and by somewhat modified shapes of the flanges 164', 165'** whose arcuate faces facilitate installation of the bearing element.

Figure 22:
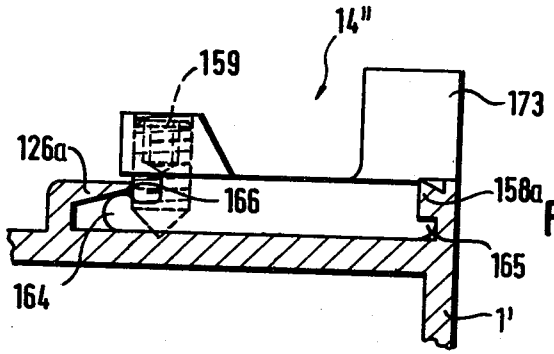

The mounting portion of the catch 14'' shown in FIG. 22 is identical with that of the bearing element **10*c* described with reference to FIG. 20 and is mounted on a member of the same frame 1'. It carries the engaging element 173** of the catch.

The catch 14a illustrated in FIG. 23 and 24 is largely identical with that described above with reference to FIGS. 7 and 8, and corresponding elements have been provided with the same reference numerals making a more detailed description unnecessary. In addition to the set screw 129, the catch 14a is provided with a set screw 159 turning about an axis 167 centered in the groove 81. The set screw 159, therefore, is effective primarily for securing the catch 14*a* in its longitudinal position in the groove 81, whereas it is the primary function of the set screw 129 to prevent angular movement of the catch about the axis 167.

The catch 14b shown in FIGS. 25 and 26 is of the same general type as the catches 14, 14*a*, and thus can be installed in the fully assembled window by turning through 90° without requiring tools other than a screw driver or wrench for tightening its set screw 159'', as more fully explained above for the catch 14. The mounting portion of the catch 14*b* is identical with that of the bearing element 10*a* described with reference to FIG. 17, but it is secured in the groove 81' of the associated frame member 1*b'* by a set screw 159'' which is offset from the axis of rotation of the catch, and thereby secures the catch both against angular displacement and longitudinal movement in the groove 81' from which the engaging element 173 projects.

The invention has been described with reference to windows whose frame and sash have four elongated members each and whose motion transmitting system extends from a control handle to the several movable fittings on the sash along two sash members only. Other arrangements, however, will readily be arrived at by those skilled in the art of the basis of the above teachings. The invention is of only limited value in windows having fewer than four frame and sash members, but readily lends itself to polygonal windows having more than four sides.

The motion transmitting bar arrangements 16 may be provided on as many sides of a window as a specific application requires, such as all four members of the illustrated sash 2 when locking devices 13 are distributed over the entire circumference of the sash for cooperation with catches on all four frame members, and when fittings other than those specifically disclosed are to be operated. Corner couplings 18 will readily be provided on as many corners as needed, and connectors 22 of reduced cross section will be received in passages of fittings, such as the cavity 27 of the channel 47, to avoid interference between the fittings and the motion transmitting mechanism.

It should be understood, therefore, that the foregoing disclosure relates only to a preferred embodiment of the invention, and that it is intended to cover all changes and modification of the example of the invention herein chosen for the purpose of the disclosure which do not constitute departures from the spirit and scope of the invention set forth in the appended claims.

What is claimed is:

1. A window comprising:

a. a frame including first, second, third and fourth elongated frame members extending about an opening in said frame;

b. a sash including first, second, third, and fourth eleongated frame members;

c. hinge means connecting said sash to said frame for swinging movement of said sash about a first pivot axis extending in a common direction with said first and third frame members toward and away from a closed position in which each sash member is contiguously juxtaposed in said opening to a corresponding frame member;

d. bearing means connecting said sash to said frame for tilting movement of said sash about a second pivot axis transverse to said first axis and extending in a common direction with said second and fourth frame members toward and away from said closed position, 1. said members defining respective corners of said frame and of said sash, a first corner being defined by said first and second members, a second corner by said second and third members, a third corner by said third and fourth members, and a fourth corner by said fourth and first members, 2. said hinge means including a corner fitting assembly having respective movably engaged fitting elements on said frame and on said sash adjacent said first corners and also constituting elements of said bearing means, a bracket member having a portion pivotally secured to said frame adjacent said fourth corner of the frame, guide means securing another portion of said bracket member to said fourthsash member for angular movement and for movement longitudinally of said fourth sash member, and arresting means on said sash for preventing said angular movement, 3. said bearing means further including pivotally engageable bearing elements on said frame and on said sash respectively adjacent said second corners, and releasable coupling means on said sash for holding said bearing elements engaged;

e. locking means for locking said sash to said frame in said closed position and including at least one catch on said frame and at least one locking member movable on said sash toward and away from engagement with said catch in said closed position;

f. a manually operable control member movably mounted on said sash; and g. motion transmitting means connecting said control member to said arresting means, said coupling means, and said at least one locking member, 1. said sash being formed with a circumferential, elongated, dove-tail groove, 2. said motion transmitting means including a plurality of bar elements received in said groove for movement longitudinally of respective sash members, and a corner coupling in one of said corners of said sash and connecting respective bar elements associated with the sash members defining said one corner, one of the connected bar elements being engaged by said control member, 3. said fitting element on said sash, said guide means, and said bearing element on said sash having respective mounting portions conformingly received in said groove and fixed to said sash, 4. one of said mounting portions bounding a passage extending therethrough longitudinally of said groove and movably receiving a longitudinal section of one of said bar elements.

2. A window as set forth in claim 1, wherein said groove is approximately T-shaped in cross section and bounded by edge portions of said sash.

3. A window as set forth in claim 1, further comprising clamping means for clamping said mounting portions to said sash and for thereby securing said one mounting portion against movement longitudinally of said groove.

4. A window as set forth in claim 3, wherein said passage is open in a transverse direction inward of said groove.

5. A window as set forth in claim 1, wherein said guide means include an elongated guide member including said one mounting portion and guided in said groove longitudinally of said fourth sash member, a fastening member having a mounting portion conformingly received in said groove in said fourth sash member, means securing said fastening member against movement in the receiving groove, and spacing means connecting said fastening member to said guide member, and adjustable for varying the spacing of said guide member from said fastening member.

6. A window as set forth in claim 1, wherein said arresting means include an arresting member mounted on an associated bar element of said motion transmitting means, said associated bar element having a mounting portion conformingly received in said groove.

7. A window as set forth in claim 1, wherein said bearing element on said sash has a mounting portion, said second sash member is formed with a part of said groove, the mounting portion of said bearing element is conformingly received in said part of said groove, and said bearing means further include a clamping screw threadedly mounted on said bearing element on said sash and engaging said second sash member for preventing movement of said bearing element longitudinally of said second sash member.

8. A window as set forth in claim 7, wherein said bearing elements have respective contact faces, one of said contact faces being convexly arcuate about an axis extending in a common direction with said second pivot axis.

9. A window as set forth in claim 8, wherein said one contact face is the contact face of said bearing element on said sash, the bearing element on said frame being formed with a recess, and said coupling means including a coupling member connected by said motion transmitting means to said control member for movement thereby into and out of said recess.

10. A window as set forth in claim 9, wherein said coupling member has a mounting portion, said third sash member is formed with a part of said groove slidable receiving the mounting portion of said coupling member in conforming engagement.

11. A window as set forth in claim 9, wherein said recess is bounded by two walls of said bearing element on said frame, said walls being substantially parallel to said second axis and diverging in a direction away from said second axis and toward said coupling member.

12. A window as set forth in claim 1, wherein said corner coupling includes an elongated flexible member having two longitudinally terminal portions secured to the bar elements associated with the two sash members defining said one corner, and sheath means for guiding said flexible member through said one corner, said guide means having a rigid guide portion receiving said flexible member therein, and a mounting portion, said two sash members being formed with respective parts of said groove, the mounting portion of said sheath means being conformingly received in said parts of said groove.

13. A window as set forth in claim 12, wherein said mounting portion is formed with a passage receiving said rigid guide portion.

14. A window as set forth in claim 1, wherein the bar element including said longitudinal section has another section outside said passage and conformingly received in said groove, said longitudinal section having a cross sectional dimension smaller than the corresponding dimension of said other section.

15. A window as set forth in claim 1, wherein said frame is formed with an elongated, dove-tail groove about said opening, said bearing element on said frame and said at least one catch having respective mounting parts, at least one of said mounting parts being conformingly received in the groove of said frame.

* * * * *